US007294034B2

(12) United States Patent
Yamada et al.

(10) Patent No.: US 7,294,034 B2
(45) Date of Patent: Nov. 13, 2007

(54) IMAGE DISPLAY APPARATUS, METHOD OF MANUFACTURING THE SAME, AND SEALING-MATERIAL APPLYING DEVICE

(75) Inventors: Akiyoshi Yamada, Fukaya (JP); Takashi Nishimura, Fukaya (JP); Hirotaka Murata, Fukaya (JP); Kazuyuki Seino, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 432 days.

(21) Appl. No.: 10/201,315

(22) Filed: Jul. 24, 2002

(65) Prior Publication Data

US 2002/0180342 A1 Dec. 5, 2002

Related U.S. Application Data

(63) Continuation of application No. PCT/JP01/00418, filed on Jan. 23, 2001.

(30) Foreign Application Priority Data

Jan. 24, 2000 (JP) ..... 2000-014393

(51) Int. Cl.
*H01J 9/00* (2006.01)
*H01J 9/24* (2006.01)

(52) U.S. Cl. ..... 445/25; 445/24

(58) Field of Classification Search ..... 313/504, 313/506, 512, 395; 445/25, 26, 24
See application file for complete search history.

(56) References Cited

U.S. PATENT DOCUMENTS 4,204,721 A * 5/1980 Hubert et al. ..... 445/25
4,712,866 A * 12/1987 Dyott ..... 385/11
5,697,825 A * 12/1997 Dynka et al. ..... 445/25
5,733,160 A * 3/1998 Jeng et al. ..... 445/24
5,788,551 A 8/1998 Dynka et al.
5,807,154 A 9/1998 Watkins et al.
5,811,927 A * 9/1998 Anderson et al. ..... 313/495
5,827,102 A * 10/1998 Watkins et al. ..... 445/25
5,917,463 A * 6/1999 Ilcisin et al. ..... 345/60
5,997,378 A 12/1999 Dynka et al.
6,146,228 A * 11/2000 Mougin et al. ..... 445/25
6,160,346 A * 12/2000 Vleggaar et al. ..... 313/512
6,195,142 B1 * 2/2001 Gyotoku et al. ..... 349/69
6,254,449 B1 * 7/2001 Nakanishi et al. ..... 445/25
6,433,487 B1 * 8/2002 Yamazaki ..... 315/169.3
6,459,198 B1 * 10/2002 Dean et al. ..... 313/493
6,545,410 B1 * 4/2003 Wu et al. ..... 313/582
6,604,970 B1 * 8/2003 Yamada ..... 445/24
6,621,220 B1 * 9/2003 Hasegawa et al. ..... 313/634

FOREIGN PATENT DOCUMENTS

EP 1 168 410 A 1/2002

(Continued)

*Primary Examiner*—Mariceli Santiago
(74) *Attorney, Agent, or Firm*—Oblon, Spivak, McClelland, Maier & Neustadt, P.C.

(57) ABSTRACT

The evacuated envelope of an image display apparatus has a rear substrate, a front substrate opposing the rear substrate, and a sidewall interposed between the rear and front substrates. A phosphor screen is formed on the inner surface of the front substrate. Electron-emitting elements are provided on the rear substrate. An indium layer is formed on a sealing surface lying between the front substrate and the sidewall. When the indium layer is heated and melted in a vacuum atmosphere, the front and rear substrates are sealed to each other, with the sidewall interposed between them.

13 Claims, 11 Drawing Sheets

FOREIGN PATENT DOCUMENTS

| | | | |
|---|---|---|---|
| GB | 943 029 A | | 11/1963 |
| JP | 53-141572 | | 12/1978 |
| JP | 59-117042 | | 7/1984 |
| JP | 7-140903 | | 6/1995 |
| JP | 9-82245 | | 3/1997 |
| JP | 9-92184 | | 4/1997 |
| JP | 11-135018 | * | 5/1999 |
| JP | 2000-243252 | | 9/2000 |
| JP | 2000-251654 | | 9/2000 |
| JP | 2000-311641 | | 11/2000 |

* cited by examiner

IMAGE DISPLAY APPARATUS, METHOD OF MANUFACTURING THE SAME, AND SEALING-MATERIAL APPLYING DEVICE

CROSS-REFERENCE TO RELATED APPLICATIONS

This is a Continuation Application of PCT Application No. PCT/JP01/00418, filed Jan. 23, 2001, which was not published under PCT Article 21(2) in English.

This application is based upon and claims the benefit of priority from the prior Japanese Patent Application No. 2000-014393, filed Jan. 24, 2000, the entire contents of which are incorporated herein by reference.

BACKGROUND OF THE INVENTION

1. Field of the Invention

The present invention relates to a flat, planar-type image display apparatus comprising an evacuated envelope, a method of manufacturing the image display apparatus, and a sealing-material applying apparatus.

2. Description of the Related Art

In recent years, display apparatuses have been developed as next-generation, lightweight, thin, planar-type displays. These apparatus comprise a phosphor screen and a number of electron-emitting elements (hereinafter called "emitters"). The emitters are arranged, opposing the phosphor screen. The emitters may be of either field emission type or surface conduction type. Display apparatuses using field emission type electron-emitting elements as emitters are generally called "field emission displays" (hereinafter referred to as "FEDs"). Display apparatuses using surface conduction type electron-emitting elements as emitters are generally called "surface conduction type electronic discharge display" (hereinafter referred to as "SEDs").

For example, FEDs generally have a front substrate and a rear substrate opposing each other and spaced apart by a predetermined distance. These substrates constitute an evacuated envelope, because they are coupled together at their circumferential edges, with a rectangle frame-like sidewall interposed between them. The phosphor screen is formed on the inner surface of the front substrate. A number of emitters are provided on the inner surface of the rear substrate. The emitters are used as electron-emitting sources. The electrons they emit excite phosphor layers, causing the phosphor layers to emit light. A plurality of support members are interposed between the front substrate and the rear substrate to withstand atmospheric pressure applied on these substrates.

The electric potential at the rear substrate is about 0V. The anode voltage Va is applied to the phosphor screen. The electron beams emitted from the emitters are applied to the red phosphor layers, that constitute the phosphor screen, to energize the phosphor layers, whereby an image is displayed.

In such a FED, the distance between the front substrate and the rear substrate can be set at several millimeters or less. Therefore, FED is lighter and thinner than the cathode-ray tube (CRT) used at present as a display of televisions or computers.

It is necessary to maintain the degree of vacuum inside the evacuated envelope at $10^{-5}$ to $10^{-6}$ Pa in the planar display apparatus described above. In the conventional evacuation method, the surface adsorption gas inside the envelope is liberated by performing baking in which the envelope is heated to about 300° C. The evacuation method cannot completely liberate the surface adsorption gas.

Jpn. Pat. Appln. KOKAI Publication No. 9-82245, for example, discloses a planar display apparatuses of various structures. In one structure disclosed, getter material such as Ti, Zr or alloy thereof covers the metal back that is formed on the phosphor screen of the front substrate. In another structure disclosed, the metal back is made of getter material. In still another structure disclosed, getter material covers the components other than the electron-emitting elements, in the image-displaying region.

In the image display apparatus disclosed in Jpn. Pat. Appln. KOKAI Publication No. 9-82245, getter material is formed in the ordinary panel process. Inevitably, the surface of getter material will be oxidized. The getter material is highly active at the surface. Once oxidized at surface, the getter material can no longer adsorb gas as much as desired.

A method of enhancing the degree of vacuum inside the evacuated envelope may be considered. In this method, a rear substrate, a sidewall, and a front substrate are brought into a vacuum chamber. These components are baked in the vacuum atmosphere and irradiated with an electron beam. The surface adsorption gas is thereby released from the rear substrate, sidewall and front substrate. Thereafter, a getter film is formed, and the sidewall, rear substrate and front substrate are sealed together, with frit glass or the like, in the vacuum atmosphere. This method can release the surface adsorption gas sufficiently by means of electron-beam washing. The getter film is not oxidized. A sufficient gas adsorption can be accomplished. In addition, the space in the image display apparatus is not wasted because no evacuation pipes are necessary.

However, to fuse the components together in a vacuum atmosphere by using frit glass, the frit glass must be heated to a high temperature of 400° C. or more. When so heated, the frit glass generates air bubbles. This degrades the airtightness, sealing strength and the like of the evacuated envelope. Consequently, the reliability of the image display apparatus decreases. In view of the characteristic of the electron-emitting elements, it may be desirable not to heat the frit glass to 400° C. or more. In such a case, the method of sealing the components with frit glass is not desirable.

BRIEF SUMMARY OF THE INVENTION

This invention has been made in view of the foregoing. An object of the invention is to provide an image display apparatus comprising an envelope which can be easily sealed and which can maintain a high vacuum, to provide a method of manufacturing the image display apparatus, and to provide a sealing-material applying apparatus.

To attain the object, an image display apparatus according to this invention comprises an envelope having a rear substrate, a front substrate opposing the rear substrate, and a number of electron-emitting elements provided in the envelope.

The front substrate and the rear substrate are sealed, at edge parts, either directly or indirectly to each other with low melting-point metal sealing material.

In the image display apparatus according to the invention, it is preferred that the low melting-point metal sealing material preferably have a melting point of 350° C. or less. Further, it is desired that the low melting-point metal sealing material be indium or an alloy containing indium.

According to the invention, there is provided a method of manufacturing an image display apparatus which comprises an envelope having a rear substrate, a front substrate opposing the rear substrate, and a number of electron-emitting elements provided in the envelope. The method comprises applying low melting-point metal sealing material to a sealing surface lying between the rear substrate and the front substrate; and sealing the rear substrate and the front substrate together, either directly or indirectly to each other, by heating the rear substrate and the front substrate in a vacuum atmosphere and by melting the low melting-point metal sealing material.

In the method of manufacturing an image display apparatus, it is preferred that the low melting-point metal sealing material have a melting point of 350° C. or less. Moreover, it is desired that the low melting-point metal sealing material be indium or an alloy containing indium. The degree of vacuum in the envelope is preferably $10^{-3}$ Pa or less.

In the method of manufacturing an image display apparatus, according to the invention, the sealing the rear substrate and the front substrate together includes heating the vacuum atmosphere to a temperature of 250° C. or more; sealing the front substrate and the rear substrate by applying the low melting-point metal sealing material to a sealing surface lying between the front and rear substrates, at a temperature lower than the temperature used in the heating the vacuum atomosphere; and a step of bringing the envelope sealed with the low melting-point metal sealing material, back into the atmosphere. The sealing may be performed by using the low melting-point metal sealing material at a temperature of 60 to 300° C.

In a method of manufacturing an image display apparatus, according to this invention, in the sealing, the front and rear substrates are moved relative to each other and are sealed to each other after low melting-point metal sealing material is applied to sealing surfaces lying between the front substrate and the rear substrate. The direction in which the rear plate and the front substrate are moved relative to each other may be any direction in a three-dimensional space, so long as the substrates approach each other. Only one of the substrates may be moved, or both substrates may be moved.

In the method of manufacturing an image display apparatus, according to this invention, a material-retaining section is provided to retain the low melting-point metal sealing material, at least of the sealing surfaces lying between the front substrate and the rear substrate. The low melting-point metal sealing material is applied onto the material-retaining section.

The material-retaining section is preferably a groove formed in the sealing surface or a layer formed on the sealing surface and made of material that exhibits high affinity with the low melting-point metal sealing material. The material exhibiting high affinity with the low melting-point metal sealing material is preferably nickel, gold, silver or copper, or an alloy thereof.

In the image display apparatus and the method of manufacturing the same, both according to the present invention, the front and rear substrates forming an envelope can be sealed together in a vacuum atmosphere, by using low melting-point metal sealing material. They are sealed at a low temperature (about 300° C. or less) that does no thermal damages to the electron-emitting elements and the like. Any components required in the conventional method, such as thin evacuation pipes, are unnecessary, and the evacuation efficiency can be very high.

Hence, the invention can provide image display apparatuses that have an envelope maintaining a high degree of vacuum and are free of an image-quality decrease due to thermal deterioration of the electron-emitting elements.

An image display apparatus according to another aspect of the present invention comprises an envelope having a rear substrate, a front substrate opposing the rear substrate, and a plurality of electron-emitting elements provided in the envelope. The front substrate and the rear substrate are sealed either directly or indirectly to each other with a base layer and a metal sealing material layer provided on the base layer and different in material from the base layer.

An image display apparatus according to this invention comprises an envelope having a rear substrate, a front substrate opposing the rear substrate and a sidewall arranged between edges of the front substrate and edges of the rear substrate, and a plurality of electron-emitting elements provided on an inner surface of the rear substrate and configured to emit electron beams. The front substrate and the sidewall, or the rear substrate and the sidewall, or the front substrate and the side wall and the rear substrate and the side wall are sealed together with a base layer and a metal sealing material layer different in material from a material of the base layer.

In this image display apparatus, the metal sealing material layer is made of low melting-point metal sealing material having a melting point of 350° C. or less. For example, the low melting-point metal sealing material may be indium or an alloy containing indium. Preferably, the base layer is made of metal paste containing at least one element selected from the group consisting of silver, gold, aluminum, nickel, cobalt and copper. Alternatively, the base layer may be a plated layer or deposited layer made of at least one element selected from the group consisting of silver, gold, aluminum, nickel, cobalt and copper. Still alternatively, it may be made of glass material or the like.

In the image display apparatus and the method of manufacturing the same, both described above, the front substrate and the rear substrate are sealed with metal sealing material, either directly or indirectly to each other. Therefore, the substrates can be sealed together at a low temperature that does no thermal damages to the electron-emitting elements or the like. A number of bubbles will not develop as in the case where frit glass or the like is used. This helps to improve the air-tightness and sealing strength of the envelope. Moreover, the base layer, which is different in material from the metal sealing material layer, prevents the metal sealing material from flowing, thus retaining the material at a predetermined position, even when the metal sealing material melted to have its viscosity reduced. Hence, the invention can provide an image display apparatus and a method of manufacturing the same, in which the metal sealing material can easily be treated and the sealing step can be performed in a vacuum atmosphere easily and reliably.

According to this invention, there is provided a method of manufacturing an image display apparatus which comprises an envelope having a rear substrate, a front substrate opposing the rear substrate, and a plurality of electron-emitting elements provided in the envelope. This method comprises applying molten metal sealing material to a sealing surface lying between the rear substrate and the front substrate, while applying ultrasonic waves; and heating and melting the metal sealing material in a vacuum atmosphere after the metal sealing material has been applied, and sealing the rear substrate and the front substrate at the sealing surface, either directly or indirectly to each other.

According to the invention, there is provided a method of manufacturing an image display apparatus which comprises an envelope having a rear substrate, a front substrate opposing the rear substrate, a sidewall arranged between edges of the front substrate and edges of the rear substrate; and a plurality of electron-emitting elements provided in the envelope, wherein the front substrate and the sidewall, or the rear substrate and the sidewall, or the front substrate and the side wall and the rear substrate and sidewall are sealed together with a metal sealing material layer. The method comprises applying molten metal sealing material to a sealing surface lying between the rear substrate and the front substrate, while applying ultrasonic waves; and heating and melting the metal sealing material in a vacuum atmosphere after the metal sealing material has been applied, and sealing the rear substrate, the front substrate and the sidewall together at the sealing surface.

In this method of manufacturing an image display apparatus, according to the invention, the applying the metal sealing material includes continuously applying the molten metal sealing material along the sealing surface, thereby forming a metal sealing material layer that extends along the sealing surface.

The method of manufacturing an image display apparatus, according to this invention, may comprise forming a base layer on the sealing surface. The base layer is different in material from the metal sealing material layer. In this method, the metal sealing material is applied onto the base layer after the base layer has been formed.

In the method of manufacturing an image display apparatus, according to the invention, the metal sealing material may be low melting-point metal sealing material that has a melting point of 350° C. or less. The material is, for example, indium or an alloy containing indium. Preferably, the base layer is made of material that exhibits good wettability and air-tightness with respect to the metal sealing material. In other words, it should be made of material exhibiting high affinity with the metal sealing material. The base layer may be made by applying metal paste containing at least one element selected from the group consisting of silver, gold, aluminum, nickel, cobalt, copper nickel, gold, silver and copper. Alternatively, it may be a plated layer or deposited layer made of at least one element selected from the group consisting of silver, gold, aluminum, nickel, cobalt and copper, or is a glass material layer.

In the method of manufacturing an image display apparatus, described above, the front substrate and the rear substrate are sealed by using a metal sealing material layer, either directly or indirectly to each other. The substrates can therefore be sealed together at such a low temperature as would not do thermal damages to the electron-emitting elements and the like provided on the rear substrate. Further, a number of bubbles will not develop as in the case where frit glass or the like is used. This helps to improve the air-tightness and sealing strength of the envelope. In addition, the metal sealing material has its wettability to the sealing surface improved, because ultrasonic waves are applied while the metal sealing material is being applied to the sealing surface. Thus, the metal sealing material can remain at a desired position even if it is indium or the like. Hence, the present invention can provide a method of manufacturing an image display apparatus, in which the components can be sealed together in a vacuum atmosphere, both easily and reliably.

The molten metal sealing material may be continuously applied along the sealing surface, while ultrasonic waves are being applied. Thus applied, the material can form a metal sealing material layer that extends along the sealing surface, without breaks.

A base layer, different in material from the metal sealing material, is formed on the sealing surface. Then, the metal sealing material is applied onto the base layer while ultrasonic waves are being applied. Hence, even if the metal sealing material applied is heated and melted, the base layer prevents the molten metal sealing material from flowing. That is, the base layer holds the molten material at a predetermined position. It is therefore easy to treat the metal sealing material. The sealing can be performed in a vacuum atmosphere, both easily and reliably. In particular, a part of the metal sealing material diffuses into the base layer, forming an alloy layer, when the material is applied while ultrasonic waves are being applied. This more reliably prevents the metal sealing material from flowing and holds the same at the predetermined position, in the course of the sealing.

In the applying the metal sealing material, the rate at which the metal sealing material is applied can be controlled by changing either output magnitude of the ultrasonic waves or a diameter of a port for applying the metal sealing material.

An apparatus for applying metal sealing material, according to the present invention, comprises: a supporting base for positioning an object having a sealing surface; an applying head having a storage section storing molten metal sealing material, a nozzle which applies to the sealing surface the molten metal sealing material supplied from the storage section, and an ultrasonic wave generating section which applies ultrasonic waves to the molten metal sealing material applied from the nozzle to the sealing surface; and a head-moving mechanism which moves the applying head relative to the sealing surface.

An image display apparatus according to this invention comprises an envelope having a rear substrate, a front substrate opposing the rear substrate and sealed either directly or indirectly to the rear substrate with metal sealing material, and a number of electron-emitting elements provided in the envelope. The metal sealing material is provided on a sealing surface lying between the rear substrate and the front substrate, forming a metal sealing material layer that extends along the entire of the sealing surface. The metal sealing material layer has bent or curved parts at one portion, at least, which extends along a straight part of the sealing surface.

An image display apparatus according to the present invention comprises an envelope having a rear substrate, a front substrate opposing the rear substrate and sealed either directly or indirectly to the rear substrate with metal sealing material, and a number of electron-emitting elements provided in the envelope. The metal sealing material is provided on a sealing surface lying between the rear substrate and the front substrate, forming a metal sealing material layer that extends along the entire of the sealing surface. The metal sealing material layer has an edge at one portion, at least, which extends along a straight part of the sealing surface. The edge has projections.

A method according to the invention is designed to manufacture an image display apparatus comprising an envelope having a rear substrate, a front substrate opposing the rear substrate and sealed either directly or indirectly to the rear substrate with metal sealing material, and a number of electron-emitting elements provided in the envelope. The method comprises applying metal sealing material to a sealing surface laying between the rear substrate and the front substrate, thereby forming a metal sealing material layer which extends along the entire of the sealing surface; and heating and melting the metal sealing material in a vacuum atmosphere after the metal sealing material has been applied, and sealing the rear substrate and the front substrate at the sealing surface, either directly or indirectly to each other. In the applying the metal sealing material, bent or curved parts are formed at one portion, at least, of the metal sealing material layer. The portion extends along a straight part of the sealing surface.

In another method of manufacturing an image display apparatus, according to the invention, comprises applying metal sealing material on a sealing surface lying between the rear substrate and the front substrate, thus forming a metal sealing material layer that extends the entire of the sealing surface; and heating and melting the metal sealing material in a vacuum atmosphere after the metal sealing material has been applied, thus sealing the rear substrate and the front substrate at the sealing surface, either directly or indirectly to each other. In the applying the metal sealing material, the material is applied such that projections are formed at one portion, at least, of the metal sealing material layer. The portion extends along a straight part of the sealing surface.

In both the image display apparatus and the method of manufacturing the same, both according to this invention, the metal sealing material may be low melting-point metal sealing material that has a melting point of 350° C. or less. The material is, for example, indium or an alloy containing indium.

In both the image display apparatus and the method of manufacturing the same, described above, the front substrate and the rear substrate are sealed by using a metal sealing material layer, either directly or indirectly to each other. The substrates can therefore be sealed together at such a low temperature as would not do thermal damages to the electron-emitting elements and the like provided on the rear substrate. Further, a number of bubbles will not develop as in the case where frit glass or the like is used. This serves to enhance the air-tightness and sealing strength of the envelope.

Moreover, one portion, at least, of the metal sealing material layer, which extends along a straight part of the sealing surface, has bent or curved parts. Alternatively, one portion, at least, of the metal sealing material layer, which extends along a straight part of the sealing surface, has projections. The bent parts, the curved parts, or the projections prevent the metal sealing material from flowing, thus retaining the material at a predetermined position, even when the metal sealing material melted to have its viscosity reduced. That is, they can hold the material at a predetermined position. The invention can therefore provide an image display apparatus and a method of manufacturing the same, in which the metal sealing material can easily be treated and the sealing step can be performed in a vacuum atmosphere, both easily and reliably.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereafter, an embodiment of the invention, which is an image display apparatus of this invention, i.e., an FED, will be described in detail with reference to the accompanying drawings.

Figure 1:
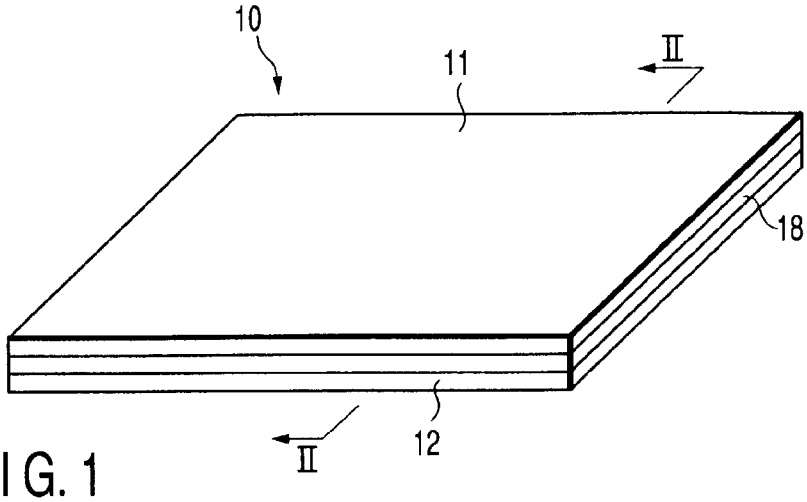
FIG. 1 is a perspective view showing an FED according to an embodiment of this invention.
Figure 2:
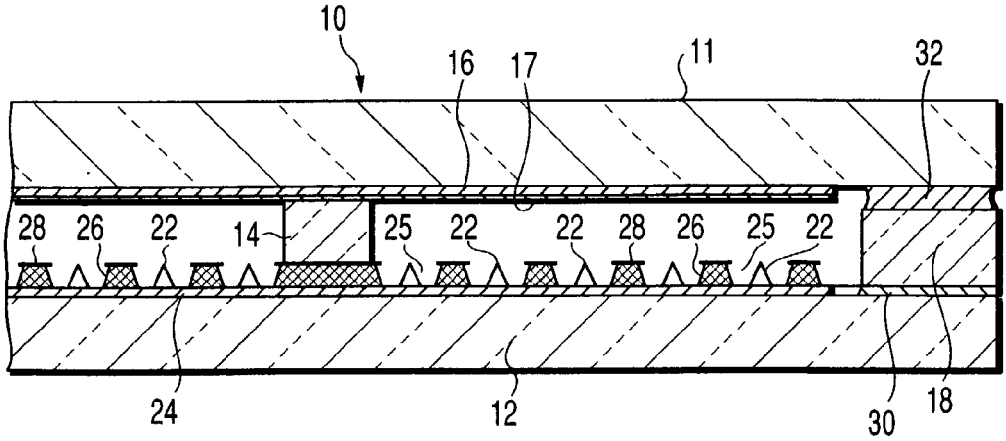
FIG. 2 is a cross-sectional view taken along line II-II in FIG. 1.

As FIGS. 1 and 2 show, the FED comprises a front substrate 11 and a rear substrate 12. The substrates 11 and 12 are rectangular glass plates and serve as insulating substrates. The substrates oppose each other, spaced apart by a distance of about 1.5 to 3.0 mm. The front substrate 11 and the rear substrate 12 are sealed together at their circumferential edges, with a rectangular frame-shaped sidewall 18 interposed between them, thereby constituting an evacuated envelope 10. The envelope 10 is flat and rectangular, maintaining a vacuum in it.

A plurality of support members 14 are provided in the evacuated envelope 10. The members 14 withstand atmospheric pressure exerted on the rear substrate 12 and the front substrate 11. The support members 14 extend parallel to the long sides of the evacuated envelope 10 and are spaced apart by a prescribed distance in the direction parallel to the short sides of the envelope 10. The shape of the support members 14 is not limited to this. The members 14 may be shaped like pillars.

Figure 3:
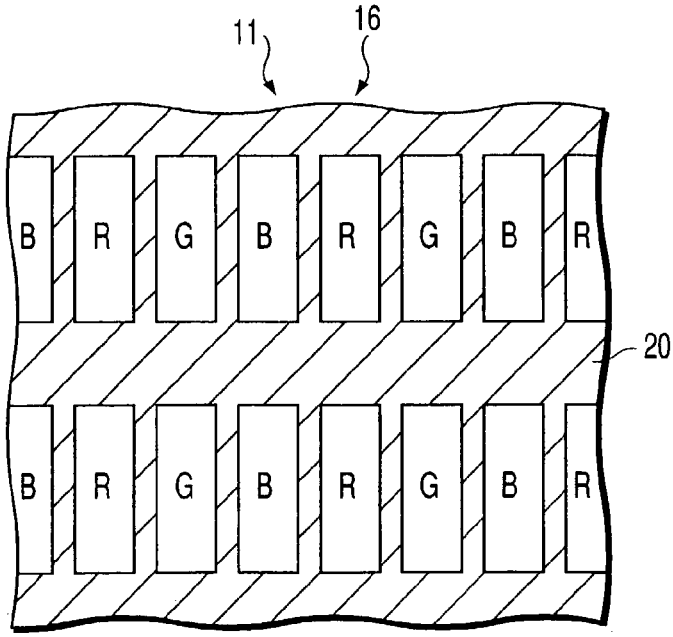
FIG. 3 is a plan view depicting the phosphor screen of the FED.

As FIG. 3 shows, a phosphor screen 16 is formed on the inner surface of the front substrate 11. The phosphor screen 16 comprises phosphor layers R, G and B which can emit red light, green light and blue light, respectively, and the matrix-shaped, light-absorbing black part 20. The support members 14 are placed behind the light-absorbing black part 20.

A metal back layer 17 is provided on the phosphor screen 16. The layer 17 is a conductive thin film, such as aluminum film. The metal back layer 17 reflects that part of the light generated by the phosphor screen 16, which travels toward the rear substrate 2 that serves as an electron source. The layer 17 therefore increases luminosity. The metal back layer 17 imparts conductivity to the image-displaying region of the front substrate 11, thus preventing accumulation of electric charges. Hence, the layer 17 functions as an anode for the electron-emitting source provided on the rear substrate 12, which will be described later. The layer 17 performs another function; it protects the phosphor screen 16 from damages due to the ions generated when gas in the evacuated envelope 10 is ionized with an electron beam.

As shown in FIG. 2, a number of electron-emitting elements 22 of field emission type are provided on the inner surface of the rear substrate 12. The electron-emitting elements 22 are sources of electrons and emit an electron beam that excites the phosphor layers R, G and B. The electron-emitting elements 22 correspond to pixels, respectively. They are arranged in rows and columns and function as pixel-displaying elements in this invention.

More specifically, a conductive cathode layer 24 is formed on the inner surface of a rear substrate 12. A silicon dioxide film 26 having many cavities 25 is formed on the cathode layer. On the silicon dioxide film 26, cone-shaped gate electrodes made of molybdenum or the like are formed in the cavities 25 made in the inner surface of the rear substrate 12. Wires (not shown) and the like, which are arranged in the form of a matrix, are formed on the rear substrate 12 and are connected to the electron-emitting elements 22.

In the FED described above, video signals are input into the electron-emitting elements 22 and the gate electrodes 28 which were arranged in the form of a simple matrix. If the electron-emitting elements 22 are used as reference, a gate voltage of +100V is applied in a state of the highest luminosity. A voltage of +10 kV is applied to the phosphor screen 16. The intensity of the electron beam emitted from each electron-emitting element 22 is modulated by the voltage applied to the gate electrode 28. An image is displayed when the electron beam excites the phosphor layers of the phosphor screen 16, causing the phosphor layers to emit light.

The high voltage is thus applied to the phosphor screen 16. Therefore, a high strain point glass is used for the glass plates constituting the front substrate 11, rear substrate 12, sidewall 18 and support-member 14. Low melting-point glass 30, such as a frit glass, seals the rear substrate 12 and the sidewall 18 together, as will be described later. The front substrate 11 and the sidewall 18 are sealed together by means of a layer 32 of low melting-point metal such as indium (In) which is formed on the sealing surface.

Next, a method of manufacturing the FED constituted as described above will be described in detail.

First, a phosphor screen 16 is formed on the glass plate used as a front substrate 11. The screen 16 is made by the following method. First, a glass plate of the same size as the front substrate 11 is prepared. A pattern of phosphor layers is formed on the glass plate by means of a plotter machine. The glass plate, with the phosphor pattern formed on it, is mounted on a positioning jig. The jig holding the phosphor pattern is placed on an exposure table. Then, the pattern is exposed to light and developed, providing the phosphor screen 16.

Next, an Al film having a thickness of 2500 nm or less is formed by the vapor deposition, sputtering, or the like, on the phosphor screen 16 thus formed. The Al film constitutes a metal back layer 17.

Then, the electron-emitting elements 22 are formed on the rear substrate 12 that is an insulating substrate made of glass or ceramics. In this case, a conductive cathode layer shaped like a matrix is formed on the glass plate. An insulating film made of silicon dioxide is formed on the conductive cathode layer by, for example, thermal oxidation, CVD, or sputtering.

Thereafter, a metal film, such as molybdenum, niobium or the like, for use in forming gate electrodes, is formed on this insulated film by for example, sputtering or electron-beam vapor deposition. A resist pattern that has a shape similar to the gate electrode to be formed on the metal film is formed by means of lithography. The metal film is subjected to wet etching method or dry etching, in which resist pattern is used as mask. The gate electrode 28 is thereby formed.

Next, the insulated film is subjected to wet etching or dry etching, in which the resist pattern and the gate electrodes are used mask. Cavities 25 are thereby made. The resist pattern is removed, and electron-beam vacuum evaporation is performed in a direction that inclines to the rear substrate at a predetermined angle. An exfoliation layer made of aluminum, nickel, or cobalt is formed on the gate electrode 28. Then, molybdenum, for example, is vapor-deposited as material of the rear substrate, in a vertical direction to the rear substrate by the electron-beam vapor deposition. The electron-emitting elements 22 are thereby formed in the cavities 25. An exfoliation layer is then removed by lift-off method, together with the metal film formed on it.

Thereafter, the peripheral edge of the rear substrate 12 that contains the electron-emitting elements 22 and the rectangle frame-like sidewalls 18 are sealed together in the atmosphere, by using low melting-point glass 30. At the same time, a plurality of support members 14 are sealed with low melting-point glass 30 to the rear substrate 12 in the atmosphere.

More specifically, the organic solvent and a frit glass are mixed. Binder such as cellulose nitrate is added to the resultant mixture, thus adjusting the viscosity of the mixture. Frit glass in the form of paste is thereby prepared. The frit-glass material is applied to one of the sealing surfaces of the rear substrate 12 and the sidewall 18. Then, the rear substrate 12 now coated with the frit glass 30 and the sidewall 18 are set in mutual contact. The substrate 12 and the sidewall 18 in this state are inserted to an electric furnace. In the furnace they are heated to a temperature higher than the melting point of frit glass 30. The substrate 12 and the sidewall 18 are thereby sealed together. The unit comprising the rear substrate 12 and the sidewall 18 sealed together shall be called "rear substrate-sidewall assembly."

Figure 4:
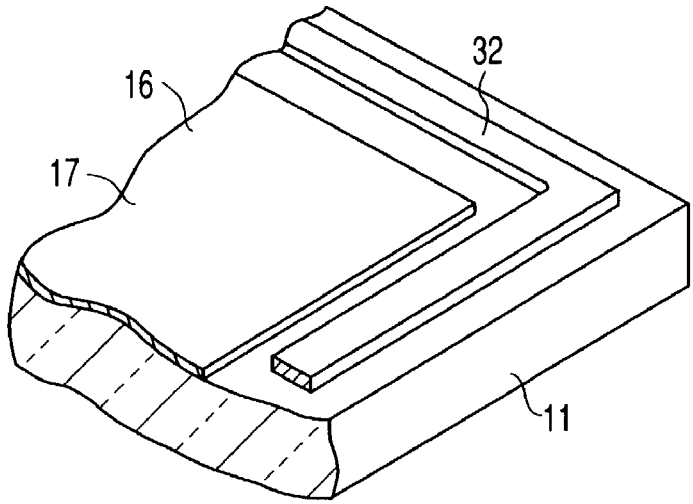
FIG. 4 is a perspective view illustrating the state where an indium layer formed in the sealing surface of the front substrate which is a component of the evacuated envelope of the FED.

The rear substrate 12 and the front substrate 11 are sealed together, with the sidewall 18 interposed between them. As FIG. 4 shows, indium used as metal sealing material is applied to the upper surface of the sidewall 18, which serves as a sealing surface, or to the peripheral edge portion of the front substrate 11. In the embodiment, the indium is applied to the peripheral edge portion of the front substrate 11. An indium layer 32 is thereby formed, extending along the entire peripheral edge of the base layer. The indium layer 32 thus formed is about 6 mm wide.

It is desired that the metal sealing material should have a low melting point of about 350° C. or less and should excel in adhesion property and junction property. Indium (In) used in the embodiment not only has a melting point as low as 156.7° C. But also has it a low vapor pressure, is soft and resistant to impacts, and is not brittle at low temperatures. This metal musing material can adhere directly to glass, depending on conditions. Therefore, it is a material that helps achieve the object this invention.

The low melting-point metal material is not limited to indium. The material may be silver oxide, silver, gold, copper, aluminum, zinc, tin or the like, or an alloy of the metals. For example, In97%-Ag3% eutectic alloy has an even lower melting point of 141° C. and yet exhibits a great mechanical strength.

The term "melting point" is used in the above description. For alloys, each composed of two or more metals, a melting point may not be given uniquely. In such a case, generally liquidus-line temperature and solidus-line temperature are defined. The former is a temperature at which a part of the molten alloy starts solidifying as it is cooled. The latter is a temperature at which the alloy solidifies in its entirety. In connection with the embodiment, the term "melting point" is used to mean the solidus-line temperature, for explanatory convenience.

Figure 5:
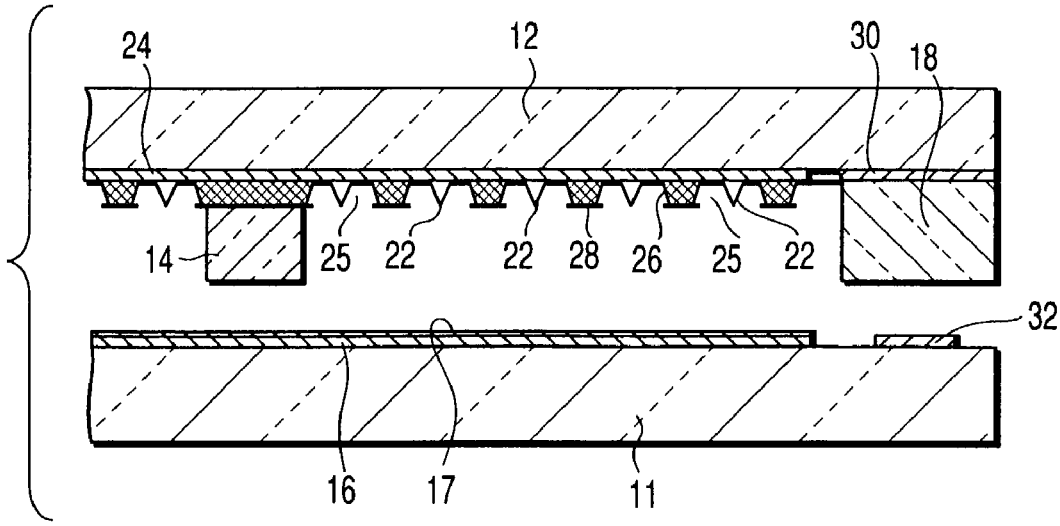
FIG. 5 is a cross-sectional view showing the front substrate and the rear substrate-sidewall assembly which oppose each other, said front substrate having an indium layer formed in the sealing part.

The front plate 11 having the indium layer 32 formed on the sealing surface of the front plate, and the rear substrate-sidewall assembly comprising the rear substrate 12 and the sidewall 18 sealed to the rear substrate are held by a jig (described later), with the sealing surfaces opposing each other and spaced apart from each other, as shown in FIG. 5. The front plate and the assembly held by the jig are inserted into a vacuum process apparatus.

Figure 6:
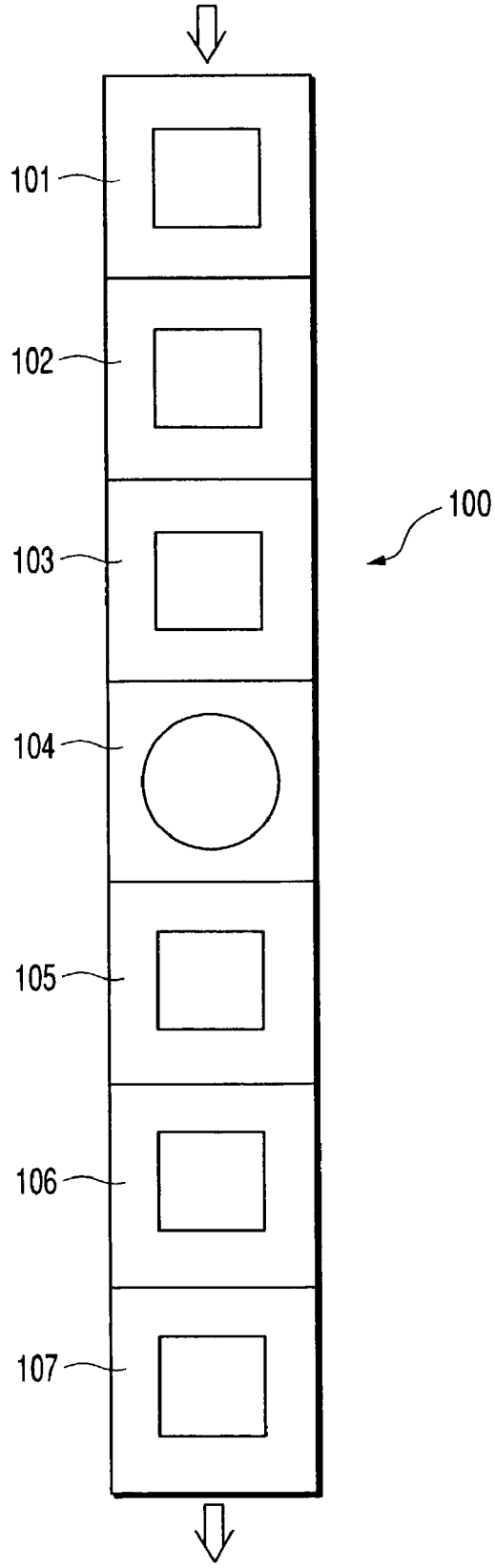
FIG. 6 is a schematic representation of the vacuum process apparatus used to manufacture the FED.

As depicted in FIG. 6, the vacuum process apparatus 100 has a loading chamber 101, a baking/electron-beam washing chamber 102, a cooling chamber 103, a vacuum evaporation chamber 104 for depositing a getter film, an assembling chamber 105, a cooling chamber 106, and an unloading chamber 107. These chambers are arranged in the order they are mentioned. Each chamber serves as a process chamber in which a vacuum process can be performed. To manufacture the FED, all chambers are evacuated. Any adjacent process chambers are connected by gate valves or the like.

The rear substrate-sidewall assembly and the front substrate 11, which oppose each other and are spaced apart by a prescribed distance, are inserted into the loading chamber 101. After a vacuum is generated in the loading chamber 101, the assembly and the front substrate 11 are transferred into the baking/electron-beam washing chamber 102. In a baking/electron-beam washing chamber 102, the rear substrate-sidewall assembly and the front substrate are heated to a temperature of about 300° C. and are thereby baked, when the vacuum attains a degree of about $10^{-5}$ Pa. The surface-adsorbed gas is fully released from every component of the assembly and the front substrate. At this temperature, the indium layer 32 (having melting point of about 156° C.) melts.

In the baking/electron-beam washing chamber 102, an electron beam generator (not shown) provided in the chamber 102 applies an electron beam to the phosphor screen provided on the front substrate 11 and the electron-emitting elements 22 provided on the rear substrate 12. The electron beam is deflected by a deflection unit that is arranged outside the electron beam generator. Therefore, the phosphor screen and the surface of every electron-emitting element 22 can be washed with the electron beam.

After heated and washed with an electron beam, the rear substrate-sidewall assembly and the front substrate 11 are transferred into the cooling chamber 103 and cooled to a temperature of, for example, 100° C. Then, the rear substrate-sidewall assembly and the front substrate 11 are transferred into the vacuum evaporation chamber 104. In the chamber 104, a Ba film is vapor-deposited, as a getter film, on the phosphor screen. The Ba film is prevented from contaminated with oxygen, carbon, and the like. The Ba film can therefore remain in active state. The getter film is formed at a temperature of 50° C. to 150° C. by vapor deposition that is usually employed in the art.

Figure 7:
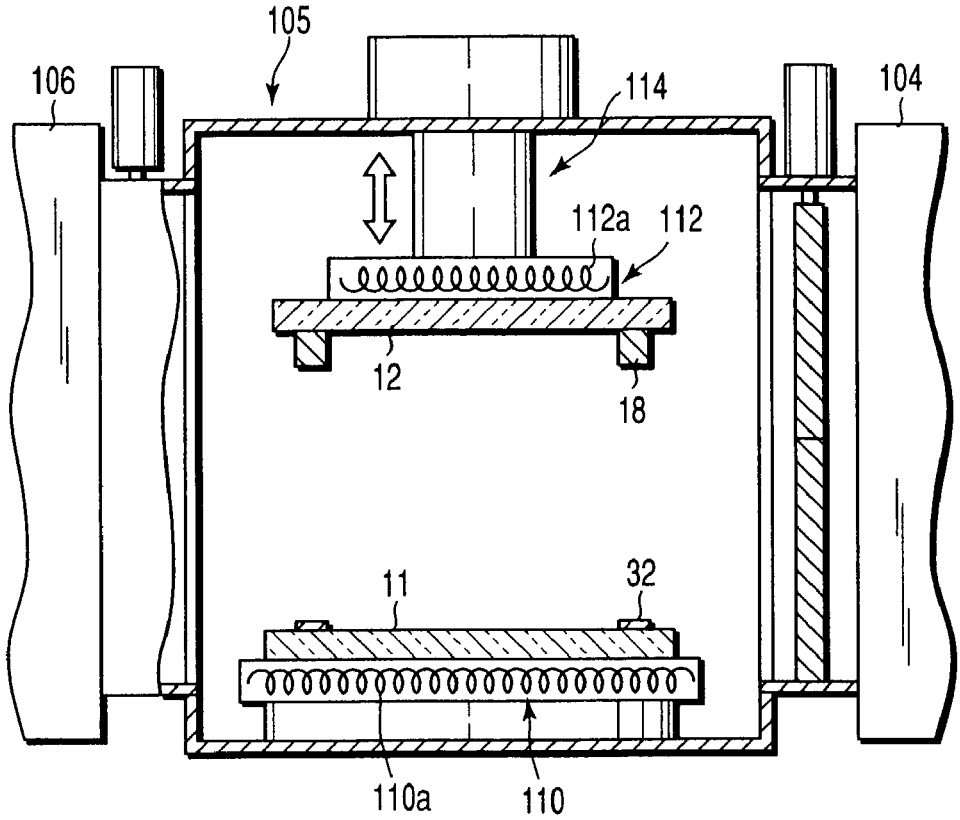
FIG. 7 is a cross-sectional view showing the assembling chamber of the vacuum process apparatus.

Next, the rear substrate-sidewall assembly and the front substrate 11, opposing each other, are transferred into the assembling chamber 105. In the assembling chamber 105, the assembly and the front substrate 11 are sealed to each other, with the indium layer 32 interposed between them. As illustrated in FIG. 7, a front-substrate base 110 that incorporates a first heater 110*a* is arranged in the assembling chamber 105 that serves as a vacuum vessel. Above the base 110 there is provided a rear-substrate holding jig 112 that incorporates a second heater 112*a*. The jig 112 faces the front-substrate base 110. The rear substrate-sidewall assembly and the front substrate 11 are supported by the jig 112 and the front-substrate base 110, respectively, and oppose each other.

The heaters 110*a* and 112*a* heats at least the junction to 350° C. or less, preferably to 60° C. to 300° C., in the assembling chamber 105, while depressurizing and evacuating the chamber 105 to a vacuum degree (atmospheric pressure) of $10^{-5}$ Pa or less. A sealing process is thereby accomplished.

When the assembling chamber 105 attains a vacuum degree of $10^{-5}$ Pa or less, the first heater 110*a* starts heating the front substrate 11 to about 200° C. Then, the indium layer 32 is melted or softened. In this state, a vertical drive unit 114 moves down the rear substrate-sidewall assembly secured to the rear-substrate holding jig 112. The sealing surface of the sidewall 18 is bought into contact with the indium layer 32 provided on a front substrate 11. Then, the indium layer 32 is cooled in the assembling chamber 105 to 50° C. or less. The indium layer 32 therefore solidifies. Thus, the indium layer 32 fuses the sidewall 18 and the front substrate 11 together, whereby an evacuated envelope 10 is formed.

The envelope 10 thus formed is cooled to normal temperature in the cooling chamber 106. Then, the envelope 10 is moved from the unloading chamber 107 into the atmosphere. The FED is thereby manufactured by the method described above.

In the method described above, which manufactures the FED, the front substrate 11 and the rear substrate 12 are sealed together in a vacuum atmosphere, and the surface adsorption gas can be sufficiently released from the substrate as the substrates 11 are baked and washed with an electron-beam. The getter film remains not oxidized, and a sufficient gas adsorption effect can be attained. Hence, the method can provide an FED that maintains a high vacuum degree and exhibits good emission characteristic for a long time. Further, the method needs no components (a small tube for exhaust gas, and the like) that the conventional method must use to exhaust the gas. The method can manufacture an FED that is thin and has good display characteristic.

The use of indium as sealing material suppresses foaming at the time of sealing. This helps to provide an FED having high air-tightness and sealing strength. Therefore, sealing can be achieved easily and reliably even if the FED is an image display apparatus of a size of 50 inches or more.

In the embodiment described above, the indium layer 32 is formed on only the sealing surface of the front substrate 11 or the sealing surface of the sidewall 18 to accomplish the sealing. Nonetheless, the indium layer 32 may be formed on both the sealing surface of the front substrate 11 and the sealing surface of the sidewall 18, in order to achieve the sealing.

The indium layer provided on the sealing surface of the front substrate 11 or the sealing surface of the sidewall 18, or on both, can be heated to a temperature higher than the melting point, outside vacuum process apparatus. In this case, the indium layer assumes a molten state and applying ultrasonic waves to the junction between the indium layer and the sealing surface to increase the adhesion at the junction.

A low melting-point metal sealing material such as indium and an indium alloy is soft (less hard) even in solid state. If the junction is heated to about 60° C. to 200° C., which is lower than the melting point, and the sidewall 18 of the rear substrate-sidewall assembly is pressed onto the indium layer 32, the sidewall 18 and the front substrate 11 can be joined and sealed together.

In the sealing process, the rear substrate-sidewall assembly may be arranged below the front substrate. If so, the front substrate is positioned, with its sealing surface facing the assembly. The vertical drive unit moves down the front substrate, thereby to seal the sidewall and the front substrate together. Further, the one circumferential edge of either the front substrate or the rear substrate may be bent, and these substrates may be directly sealed together, with no sidewall interposed between them.

Figure 8:
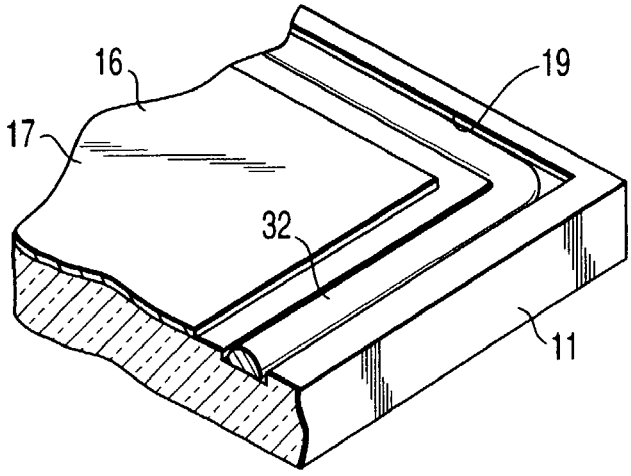
FIG. 8 is a perspective view depicting a modification of the front substrate, which has an indium layer formed in the groove made in the sealing surface.

As shown in FIG. 8, a groove 19 may be formed in the sealing surface of the front substrate 11, extending along the entire circumference, and the indium layer 32, used as a low melting-point metal material, may be provided in this groove 19. The cross section of the groove 18 may be square, round, semicircle form, or arcuate. This embodiment is identical to the first embodiment in terms of other structural aspects and sealing method.

In this structure, the indium layer 32 is melted or softened at the time of sealing and accumulated in the groove 19 of the front substrate 11. It remains at a predetermined position, not flowing out of the groove 19. It is therefore easy to handle indium. Therefore, the rear substrate-sidewall assembly and the front substrate can be sealed together both easily and reliably, even if the image display apparatus they constitute is a large one having a large size of 50 inches or more.

Next, an FED according to the second embodiment of this invention and a method of manufacturing the same will be described. The components identical to those of the first embodiment are designated at the same reference numerals and will not be described in detail.

Figure 9:
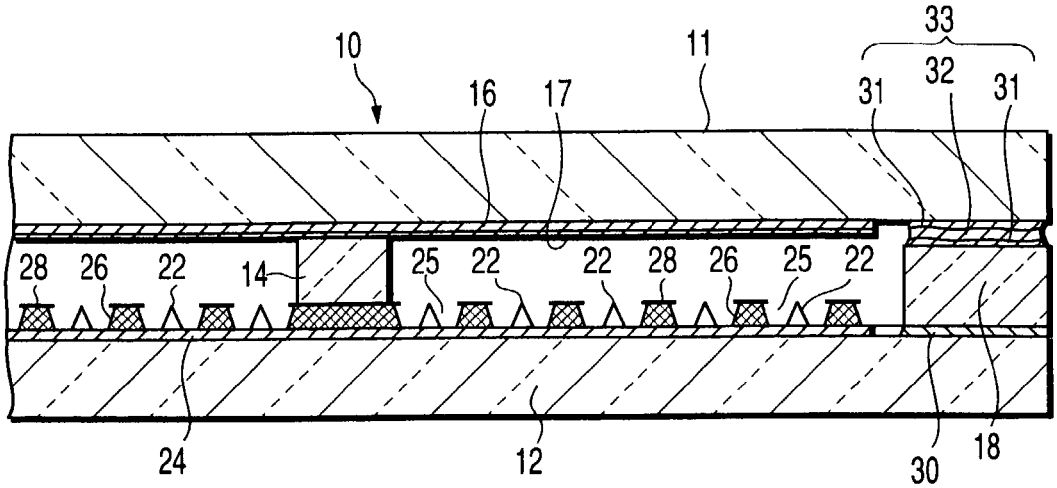
FIG. 9 is a cross-sectional view depicting an FED according to a second embodiment of the invention.

In the second embodiment, low melting-point glass 30, such as frit glass, seals the rear substrates 12 and sidewall 18 which constitute an evacuated envelope 10, as is illustrated in FIG. 9. The front substrate 11 and the sidewall 18 are sealed to each other by means of a sealing layer 33 which is composed of a base layer 31 formed on the sealing surface and an indium layer 32 formed on the base layer 31. This FED is identical to the first embodiment in any other structural features.

A method of manufacturing the FED according to the second embodiment will be explained in detail.

A front substrate 11 on which a phosphor screen 16 and a metal back 17 are provided, a rear substrate 12 on which electron-emitting elements 22 are provided, and a rectangle frame-like sidewall 18 are prepared by the same method as in the first embodiment. Then, the peripheral edge portion of the rear substrate 12, on which the electron-emitting elements 22 are provided, and the rectangle frame-like sidewall 18 are sealed together, with low melting-point glass 30 in the atmosphere. Simultaneously, a plurality of support members 14 is sealed to the rear substrate 12 in the atmosphere with low melting-point glass 30.

Figure 10A:
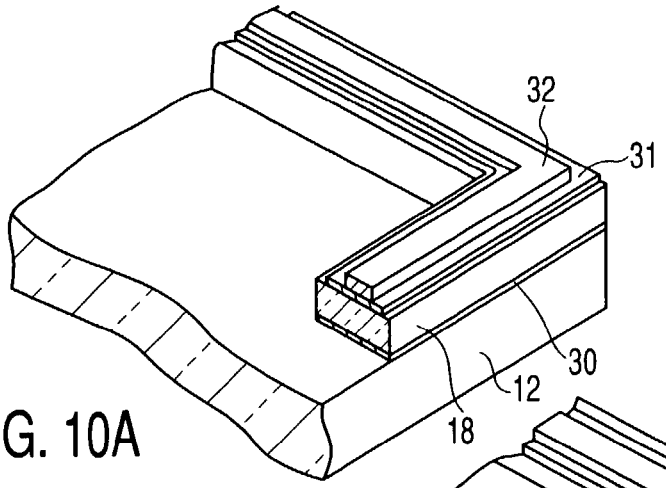
FIG. 10A is a perspective view showing a base layer and an indium layer, both provided on the sealing surface of the sidewall that is a component of the evacuated envelope of the FED.
Figure 10B:
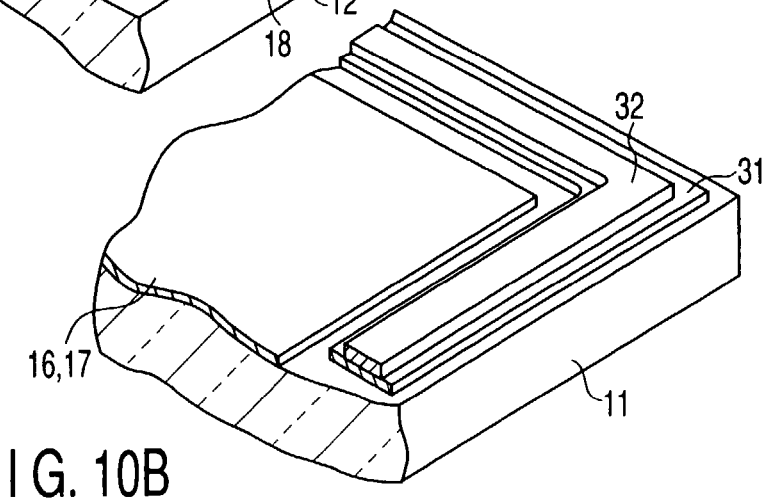
FIG. 10B is a perspective view illustrating a base layer and an indium layer, both provided on the sealing surface of the front substrate that is a component of the evacuated envelope of the FED.

Then, the rear substrate 12 and the front substrate 11 are sealed to each other, with the sidewall 18 interposed between them. More precisely, as shown in FIG. 10A and FIG. 10B, an base layer 31 having a predetermined width is formed on the upper surface of the sidewall 18 and on the peripheral edge portion of the inner surface of the front substrate 11, which serve as sealing surfaces. In this embodiment, the base layer 31 is formed by applying silver paste.

The base layer 31 is coated with indium used as low melting-point metal sealing material. An indium layer 32 is thereby formed, extending along the entire of the base layer. The indium layer 32 is narrower than the base layer 31. Therefore, the both sides of the indium layer lie at predetermined distances from the sides of the base layer 31, respectively. For example, when the width of a sidewall 18 is 9 mm, the base layer 31 and the indium layer 32 are 7 mm and about 6 mm wide, respectively.

The low melting-point, metal sealing material is not limited to indium (In). Rather, it may be sliver oxide, silver, gold, copper, aluminum, zinc or tin, or an alloy of at least two of these metals. In97%-Ag3% eutectic alloy, for example, has a lower melting point of 141° C. and a greater mechanical strength than indium.

The base layer 31 is made of material exhibiting good wettability and high air-tightness with respect to the metal sealing material. In other words, the layer 31 is made of material having affinity with the metal sealing material. It may be made of material other than the metal paste described above. More specifically, it may be made of gold paste, aluminum paste, nickel paste, cobalt paste, or copper paste, or the like. Further, the base layer 31 may be a plated layer or deposited layer of silver, gold, aluminum, nickel, cobalt, copper or the like, or a glass material layer.

Applying of the indium to the base layer 31 formed on the sealing surface, i.e., application of indium, is performed by means of the following sealing-material applying apparatus.

Figure 11:
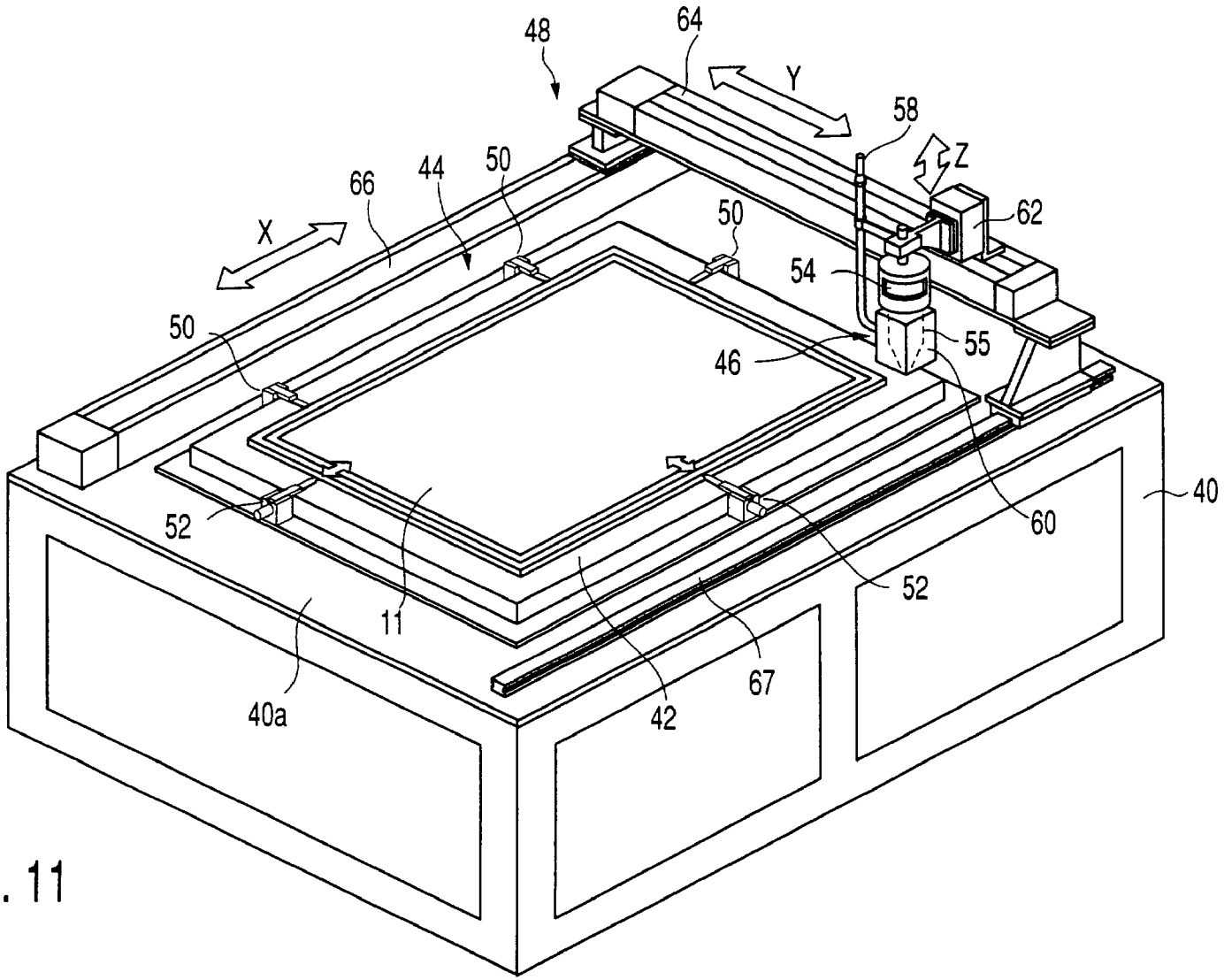
FIG. 11 is a perspective view depicting the sealing-material applying apparatus according to an embodiment of the present invention.

As shown in FIG. 11, the sealing-material applying apparatus comprises a supporting base 40 that has a flat mounting surface 40*a*.

On the mounting surface, there are arranged a hot plate 42, a positioning mechanism 44, an applying head 46, and a head-moving mechanism 48. The hot plate 42 is a flat rectangle board. The positioning mechanism 44 is designed to position on the hot plate an object to be sealed. The head-moving mechanism 48 is configured to move the applying head 46 relative to the object to be sealed.

The rear substrate 12 or the front substrate 11 is placed on the hot plate 42. Note that the rear substrate 12 is the object to be sealed and that the sidewall 18 is sealed to the hot plate 42. The hot plate 42 functions also as means for heating the object to be sealed.

The positioning mechanism 44 has three positioning claws 50 and two control claws 52. The positioning claws 50 are fixed in position. Two of the positioning claws 50 contact one side of the front substrate 11 mounted on the hot plate 42. The remaining positioning claw 50 contacts a side of the front substrate 11, which extends at right angles to said side. The control claws 52 contact the other sides of front substrate 11, respectively, to bias the front substrate 11 elastically toward the positioning claws 50.

Figure 12:
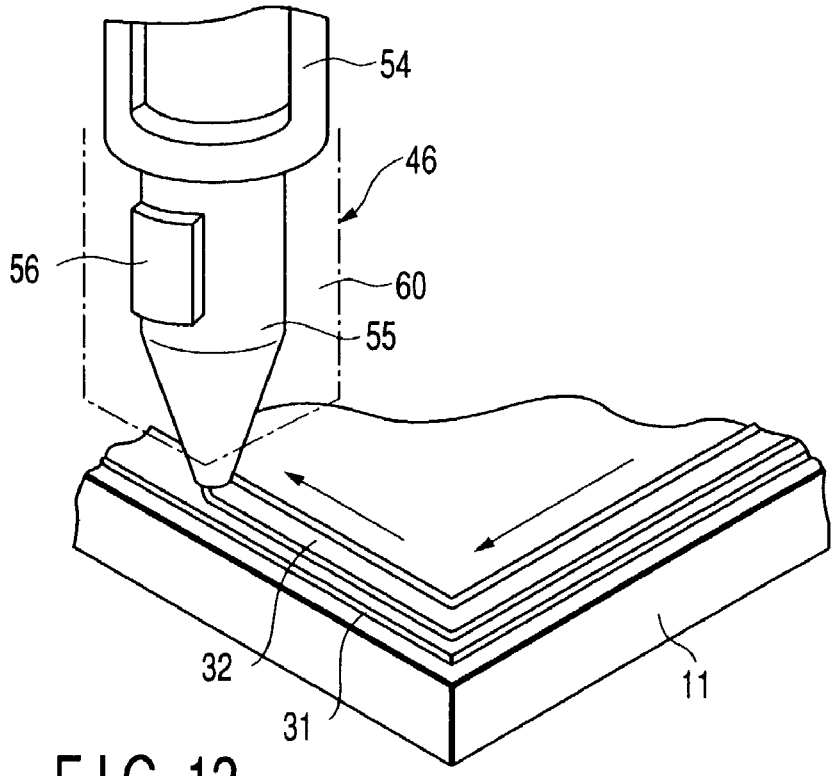
FIG. 12 is a perspective view explaining the process of applying indium to the sealing surface of the front substrate, by means of the sealing-material applying apparatus.

As FIGS. 11 and 12 show, the applying head 46 comprises a storage section 54, a nozzle 55, and an ultrasonic vibrator 56. The storage section 54 stores molten indium. The nozzle 55 receives the molten indium from the storage section 54 and applies the molten indium to the sealing surface of the front substrate 11. The ultrasonic vibrator 56 is secured to the outer surface of the nozzle 55 and functions as a section for generating ultrasonic waves. A supply pipe 58 for supplying purge gas is connected to the applying head 46. The applying head 46 incorporates a heater 60 that heats the nozzle 55.

As seen from FIG. 11, the head-moving mechanism 48 comprises a Z-axis drive robot 62 and a Y-axis drive robot 64. The Z-axis drive robot 62 supports the applying head 46 to be movable in the Z axis direction that is perpendicular to the mounting surface 40*a* of the supporting base 40, or to the front substrate 11 placed on the hot plate 42. The Y-axis drive robot 64 supports the Z-axis drive robot 62 to be movable back and forth, in the Y axis direction that is parallel to the short sides of the front substrate 11. Another X-axis drive robot 66 and an auxiliary rail 67 are secured on the mounting surface 40*a*. This X-axis drive robot 66 and the auxiliary rail 67 cooperates to support the Y-axis drive robot 64 and move the robot 64 back and forth in the X axis direction that is parallel to the long sides of the front substrate 11.

To apply indium by means of the sealing-material applying apparatus, the front substrate 11 is placed on the hot plate 12, with the sealing surface turned upward, as illustrated in FIG. 11. Then, the positioning mechanism 44 sets the front substrate 11 at a predetermined position. The applying head 46 storing molten indium is set at a applying start position, as shown in FIG. 12. The head-moving mechanism 48 moves the applying head 46 a prescribed speed along with the sealing surface of the front substrate 11, i.e., the base layer 31 formed on the front substrate 11. While the applying head 46 is being moved, the nozzle 55 continuously applies the molten indium onto the base layer 32. An indium layer 32 is thereby formed, extending along all sides of the base layer. At the same time, the ultrasonic vibrator 56 is operated, applying ultrasonic waves to the molten indium being so applied from the nozzle 55.

The ultrasonic waves are applied in a direction perpendicular to the sealing surface of the front substrate 11, i.e., the base layer formed on the front substrate 11. The frequency of an ultrasonic wave is set at, for example, 30 to 40 kHz.

As indicated above, indium is applied while ultrasonic waves are being applied. Hence, the wettability that the indium has increases, making it possible to fill the indium at any desired position. Further, indium can be continuously applied along the base layer 31, forming an indium layer that extends along all sides of the base layer. Since the molten indium is applied while ultrasonic waves are being applied, a part of the indium can diffuse into the surface of the base layer. An alloy layer can be thereby formed when the process of applying indium is completed.

In the process of applying indium, the rate of applying indium is controlled by adjusting either the oscillation magnitude of the ultrasonic waves or the diameter of the indium-applying orifice of the indium of a nozzle 55. The thickness, width and the like of the indium layer formed can, therefore, be adjusted.

To fill indium on the sealing surface of the sidewall 18 sealed to the rear substrate 12, that is, on the base layer 32 in this instance, the rear substrate 12 is positioned on the hot panel 42 of the sealing-material applying apparatus, as has been described above. The applying head 46 continuously applies molten indium along the base layer 31, while applying ultrasonic waves. An indium layer 32 is thereby formed, continuously extending along the base layer 31.

Figure 13:
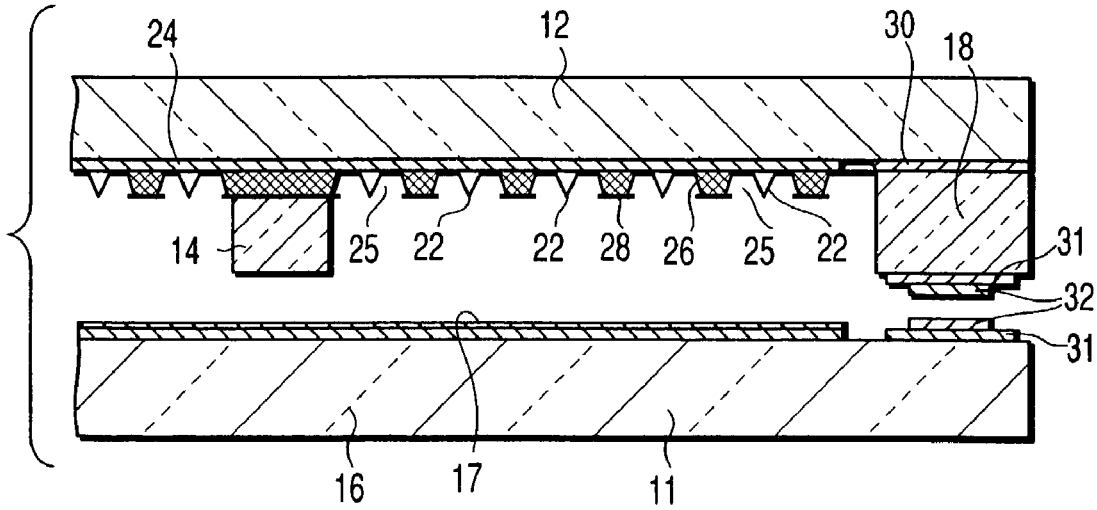
FIG. 13 is a cross-sectional view showing the front substrate and the rear substrate-sidewall assembly which oppose each other, said front substrate having a base layer and an indium layer both provided on the sealing part.

Next, as shown in FIG. 13, the front substrate 11 and the rear substrate-sidewall assembly are held with a jig or the like, with their sealing surfaces opposing each other and spaced from each other by a predetermined distance. Note that the base layer 31 and the indium layer 32 are provided on the sealing surface of the front substrate 11. Also note that the rear substrate-sidewall assembly comprises the rear substrate 12, the sidewall 18 sealed thereto, and the base layer 31 and the indium layer 32, both formed on the upper surface of the sidewall 18. The front substrate 11 and the rear substrate-sidewall assembly are inserted into the vacuum process apparatus 100 described earlier.

In the vacuum process apparatus 100 and the electron-beam washing chamber 102, the front substrate 11 and the rear substrate-sidewall assembly are heated, as in the first embodiment, to a temperature of about 300° C. and thereby baked when the degree of vacuum reaches a high value of about $10^{-5}$ Pa. Thus, the surface adsorption gas is fully released from each component.

At this temperature, the indium layer 32 (having a melting point of about 156° C.) melts. However, the indium remains on the base layer 31, not flowing from the layer 31, because the indium layer 32 is formed on the base layer 31 that exhibits high affinity with indium. This prevents indium from flowing to the electron-emitting-elements 22, flowing from the rear substrate or to the phosphor screen 16.

The rear substrate-sidewall assembly and the front substrate 11 are cooled to a temperature of about 100° C. in the cooling chamber 103, after they have been heated and washed with an electron beam. Then, in the vacuum evaporation chamber 104, vacuum evaporation formation of a Ba film is formed as getter film, outside the phosphor screen, by means of vapor deposition.

Next, the rear substrate-sidewall assembly and the front substrate 11 are transferred into the assembling chamber 105. In the assembling chamber 105, the assembly and the front substrate 11 are heated to 200° C. The indium layer 32 melts or softens to assume liquid state again. The front substrate 11 and the sidewall 18 are joined together. A predetermined pressure is applied to the front substrate 11 and the sidewall 18. The indium is gradually cooled and solidified. The sealing layer 33, which fuses the indium layer 32 and the base layer 31 together, connects the front substrate 11 and the sidewall 18. An evacuated envelope 10 is thereby formed.

The evacuated envelope 10 thus formed is cooled to normal temperature in the cooling chamber 106. The evacuated envelope 10 is removed from the unloading chamber 107. An FED is thereby manufactured by performing the above-mentioned sequence of process.

In the FED configured as specified above and in the method of manufacturing the same, the front substrate 11 and the rear substrate 12 are sealed together in a vacuum atmosphere. The surface adsorption gas is therefore fully released as the substrate 11 and the assembly are baked and washed with an electron beam. The getter film remains not oxidized, and a sufficient gas adsorption effect can be accomplished. The FED obtained can therefore maintain a high degree of vacuum.

Since indium is used as sealing material, foaming can be suppressed at the time of the sealing process. This makes it possible to provide an FED having high air-tightness and great sealing strength. In addition, indium can be prevented from flowing though it melts in the sealing process. This is because the base layer 31 is formed in the bottom of the indium layer 32. The indium layer remains at the predetermined position. That is, it is easy to handle indium. Thus, the components can be easily and reliably sealed to one another, even if they form a large-sized, 50-inch image display apparatus.

Furthermore, the wettability of indium to any sealing surface or the base layer 31 improves because indium is applied while ultrasonic waves are applied. Indium used as metal sealing material can be applied at a desired position. Molten indium can be continuously applied along the base layer 31. An indium layer can thereby be formed, extending, without breaks, along with the base layer. Moreover, if a base layer 31 is used as in this embodiment, molten indium is applied while ultrasonic waves are being applied. In this case, a part of the indium applied diffuses into the surface of the base layer 31, forming an alloy layer. Even if the indium melts at the time of sealing, it is prevented from flowing. The molten indium reliably remains at the predetermined position.

Hence, it is easy to handle the metal sealing material is easy. The invention can provide a method of manufacturing an image display apparatus, which can perform sealing easily and reliably in a vacuum.

Figure 14:
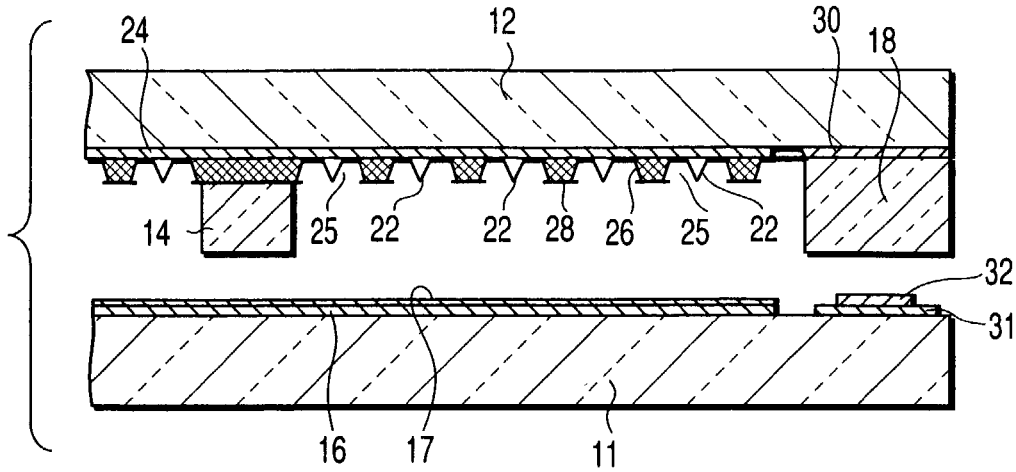
FIG. 14 is a cross-sectional view explaining how the base layer and the indium layer are formed on the sealing surface of the front substrate, in the process of forming the evacuated envelope of FED which is a modification of the second embodiment.

In the second embodiment described above, the base layer 31 and the indium layer 32 are formed on both the sealing surface of the front substrate 11 and the sealing surface of the sidewall 18, and the base layer 31 and the sidewall 18 are sealed together. Nonetheless, a base layer 31 and an indium layer 32 may be formed on only the sealing surface of either the front substrate 11 or the sidewall 18. For example, a base layer 31 and an indium layer 32 may be formed on the sealing surface of the front substrate 11 as illustrated in FIG. 14.

As in the first embodiment, an indium layer may be formed directly on the sealing surface of the substrate or sidewall, without using a base layer. In this case, too, molten indium may be applied, while applying ultrasonic waves in the sealing-material applying apparatus described above. The wettability that the indium layer exhibits with respect the sealing surface therefore improves. Hence, indium can be continuously applied at a desired position.

In the second embodiment, a sealing layer 33 that seals the base layer 31 and the indium layer 32 may be used to fuse the rear substrate 12 and the sidewall 18 together. Further, the peripheral edge portion of the front substrate or the peripheral edge portion of the rear substrate may be bent, and these substrates may be coupled together at the edge portion, using no sidewalls. The indium layer 32 need not have, in its entirety, a width smaller than that of the base layer 31. Rather, it suffices for the layer 32 to have at least one part that is less wide than the base layer 31. In this case, too, it is possible to prevent indium from flowing.

An FED according to a third embodiment of the invention and a method of manufacturing this FED will be described. The components identical to those of the first embodiment are designated at the same reference numerals and will not be described in detail.

Figure 15:
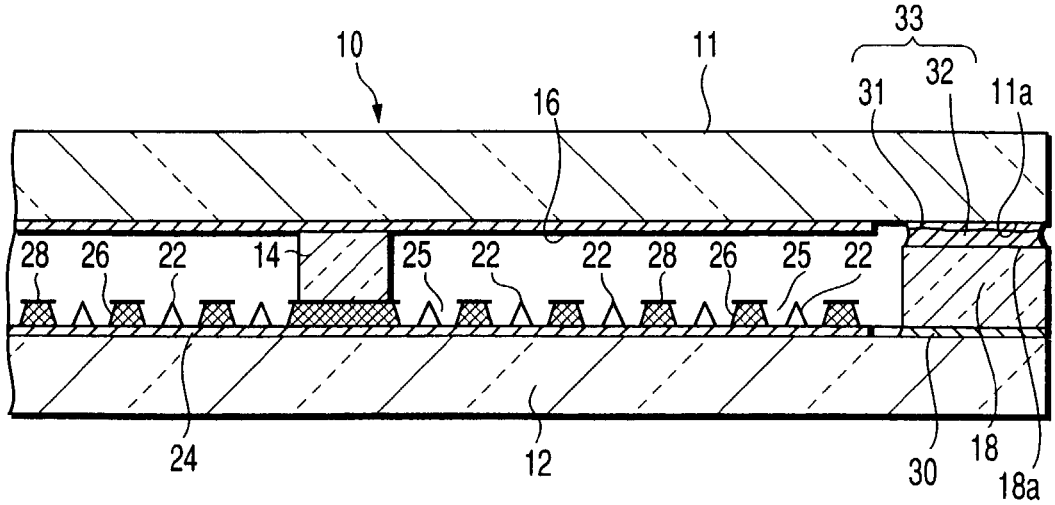
FIG. 15 is a cross-sectional view showing an FED according to the third embodiment of this invention.

In the third embodiment, low melting-point glass 30, such as a frit glass, seals the rear substrate 12 and the sidewall 18 that form an evacuated envelope 10, as is illustrated in FIG. 15. A base layer 31 formed on the sealing surface and an indium layer 32 formed on the base layer 31 seal the front substrate 11 and the sidewall 18. The FED is identical in structure to the first embodiment in any other structural aspects.

The method of manufacturing the FED according to the third embodiment will be explained in detail.

First, the front substrate 11, the rear substrate 12, and the sidewall 18 are prepared in the same way as in the first embodiment. The front substrate 11 comprises a phosphor screen 16 and a metal back 17. The rear substrate 12 has electron-emitting elements 22 provided on it. Then, the edges of the rear substrate 12, on which the electron-emitting elements 22 are formed, are sealed to the sidewall 18 shaped like a rectangle frame, with low melting-point glass 30 in the atmosphere. Simultaneously, a plurality of support members 14 is sealed to the rear substrate 12 with low melting-point glass 30 in the atmosphere.

Figure 16A:
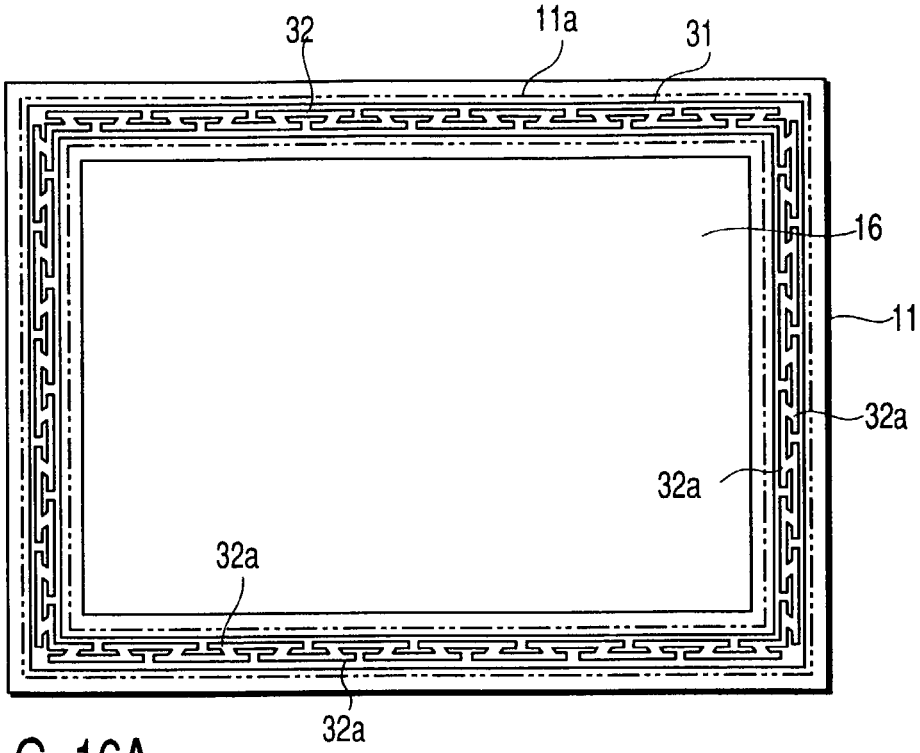
FIG. 16A is a plan view showing a base layer and an indium layer, both provided on the sealing surface of the front substrate that constitutes the evacuated envelope of the FED according to the third embodiment.
Figure 16B:
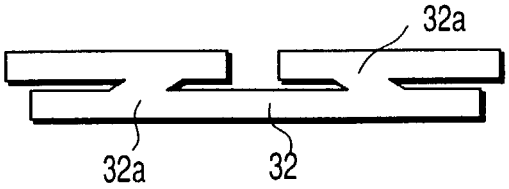
FIG. 16B is a magnified plan view illustrating the pattern of the indium layer.
Figure 17:
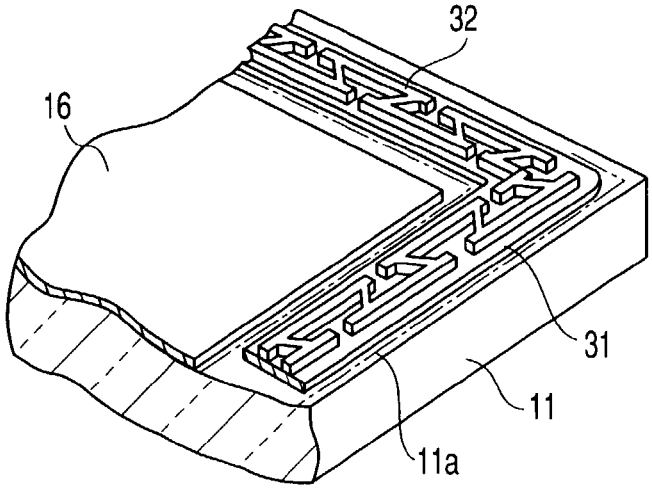
FIG. 17 is a perspective view showing a base layer and an indium layer, both provided on the sealing surface of the front substrate.

Thereafter, the rear substrate 12 and the front substrate 11 are sealed together, with the sidewall 18 interposed between them. More precisely, a base layer 31 is formed on the inner surfaces of all edge parts of the front substrate 11, which serve as a sealing surface 11*a* of the front substrate 11, as shown in FIGS. 16A, 16B and 17. The sealing surface 11*a* is shaped like a rectangular frame and corresponds to the upper surface of the sidewall 18 that serves as the sealing surface 18*a* of the rear substrate 12. The sealing surface 11*a* extends along the peripheral edge of the front-substrate 11. The surface 11*a* has two sets of straight parts and four corner parts. The straight parts of each set oppose each other. The sealing surface 11*a* has almost the same dimension and the same width as the upper surface of the sidewall 18.

The base layer 31 is formed, a slightly less wide than sealing surface 11*a*. In this embodiment, the base layer 31 is formed by applying silver paste.

Then, indium is applied as metal sealing material onto the base layer 31, thus forming an indium layer 32. The indium layer 32 continuously extends, without breaks, along the base layer 31. Those portions of the indium layers 32, which extend along the straight parts of sealing surface 11*a*, comprise each a rigid-frame like patterns. These patterns are arranged at a predetermined pitch and have sharply bent parts 32*a* each. The indium layer 32 has an almost fixed width. Both sides of the indium layer 32 have many bent parts, too. Note that the indium layer 32 lies on base layer 31, not extending from the layer 31.

The metal sealing material used is identical to those used in the other embodiments described above. The base layer is made of the same identical as those of the other embodiments.

Figure 18:
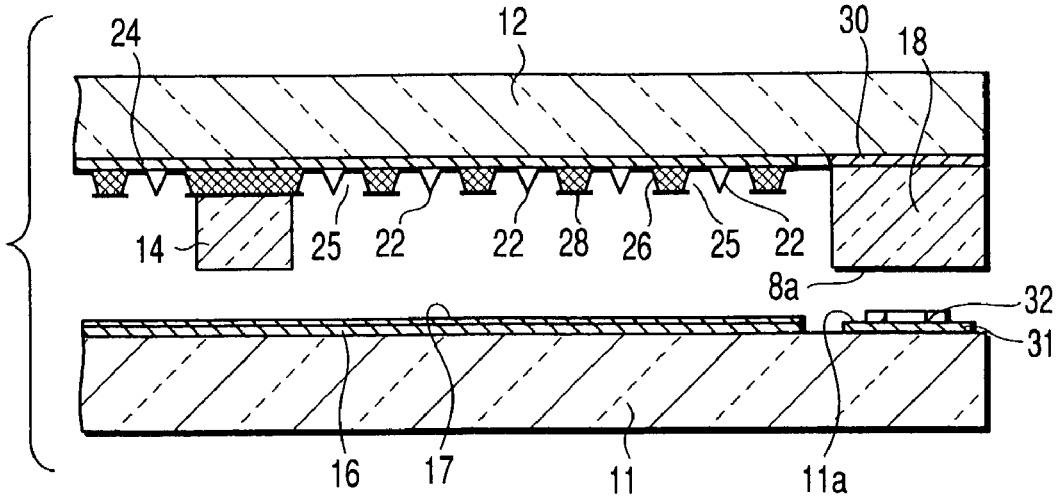
FIG. 18 is cross-sectional view depicting the front substrate and the back-substrate assembly which oppose each other, said front substrate having a base layer and an indium layer provided on the sealing part.

The front substrate 11 having the base layer 31 and the indium layer 32 formed on the sealing surface 11*a*, and the rear substrate-sidewall assembly comprising the rear substrate 12 and the sidewall 18 sealed to the substrate 12 are held by a jig or the like, with the sealing surfaces 11*a* and 18*a* opposing each other and spaced apart by a predetermined distance, as shown in FIG. 18. The front substrate 11 and the rear substrate-sidewall assembly, thus held, are inserted into the vacuum process apparatus 100 described above.

As in the first embodiment, the assembly and the front substrate 11 are transferred into the baking/electron-beam washing chamber 102. In a baking/electron-beam washing chamber 102, the rear substrate-sidewall assembly and the front substrate are heated to a temperature of about 300° C. and are thereby backed, when the vacuum attains a degree of about $10^{-5}$ Pa. The surface-adsorbed gas is fully released from every component of the assembly and the front substrate.

At this temperature, the indium layer 32 (having melting point of about 156° C.) melts. Nonetheless, molten indium is prevented from flowing, because the indium layer 32 is provided in the form of the pattern having a number of bent parts 32*a*, as indicated above. In addition, since the indium layer 32 is formed on the base layer 31 that exhibits high affinity with indium, the molten indium remains on the base layer 31, not flowing from the layer 31. Thus, the molten indium would not flow from the base layer 31 to the electron-emitting-elements 22, from the rear substrate, or to the phosphor screen 16.

The rear substrate-sidewall assembly and the front substrate 11 are cooled to a temperature of about 100° C. in the cooling chamber 103, after they have been heated and washed with an electron beam. Then, in the vacuum evaporation chamber 104, vacuum evaporation formation of a Ba film is formed as getter film, outside the phosphor screen, by means of vapor deposition.

Next, the rear substrate-sidewall assembly and the front substrate 11 are transferred into the assembling chamber 105. In the assembling chamber 105, the assembly and the front substrate 11 are heated to 200° C. The indium layer 32 melts or softens to assume liquid state again. Since the indium layer 32 is formed in the shape of the pattern having a number of bent part 32*a* and is formed on the base layer 31 exhibiting high affinity with indium, as indicated above, the molten indium remains on the base layer 31, not flowing from the layer 31. The front substrate 11 and the sidewall 18 are joined together in this condition. A predetermined pressure is applied to the front substrate 11 and the sidewall 18. The indium is gradually cooled and solidified. The sealing layer 33, which fuses the indium layer 32 and the base layer 31 together, connects the front substrate 11 and the sidewall 18. An evacuated envelope 10 is thereby formed.

The evacuated envelope 10 thus formed is cooled to normal temperature in the cooling chamber 106. The evacuated envelope 10 is removed from the unloading chamber 107. An FED is thereby manufactured by performing the above-mentioned sequence of process.

In the FED configured as specified above and in the method of manufacturing the same, the front substrate 11 and the rear substrate 12 are sealed together in a vacuum atmosphere. The surface adsorption gas is therefore completely released as the substrate 11 and the assembly are baked and washed with an electron beam. The getter film remains not oxidized, and a sufficient gas adsorption effect can be accomplished. The FED obtained can therefore maintain a high degree of vacuum.

Since indium is used as sealing material, foaming can be suppressed at the time of the sealing process. This makes it possible to provide an FED having high air-tightness and great sealing strength. Further, the indium, if melted during the sealing process, can remain at a prescribed position, not flowing from the position, because the indium layer 32 is formed in a pattern having a number of bent parts 32*a*. Hence, it is easy to handle indium. The components can be easily and reliably sealed to one another, even if they form a large-sized, 50-inch image display apparatus.

In the present embodiment, the indium layer 32 is formed on the high base layer 31 that exhibits high affinity with indium. Therefore, indium, if melting during the sealing process, is more reliably prevented from flowing than in the other embodiments. This renders it possible to accomplish easy and reliable sealing.

In the embodiment described above, the indium layer 32 extends along all straight edges of the sealing part 11*a*. and each portion extending one edge of the sealing part 11*a* has a number of bent parts over its entire length. Nevertheless, each portion of the layer 32 may have bent parts or curbed parts at only one part or more. In this case, too, the molten indium can be prevented from flowing as in the embodiment described above.

The patterns constituting the indium layer 32 is not limited to frame-structure ones. Rather, they may be such patterns as illustrated in FIG. 19A to FIG. 19D. The patterns of FIG. 19A to FIG. 19D result in the same functional advantage. The indium layer 32 may have the saw-toothed pattern of FIG. 19A, consisting of bent parts 32, each bent at an acute angle θ. It may have a crank-shaped pattern of FIG. 19B, having bent parts 32 bent at almost right angles. It may have the pattern of FIG. 19C consisting of bent parts, each bent in the form of an inverted triangle. It may have the waving pattern of FIG. 19D, consisting of arcuate parts 32*b*. Alternatively, the indium layer 32 may have a pattern that consists of bent parts and curved parts.

In the various embodiments and various modifications, described above, the indium layer 32 has fixed width. Nonetheless, the indium layer may consist of parts having different widths so that one side or both sides are undulated.

Figure 20A:
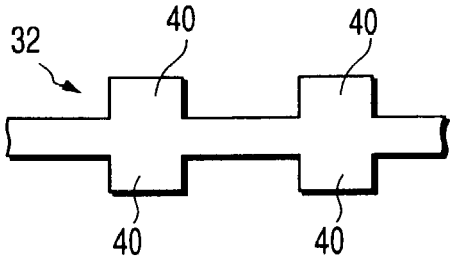
FIG. 20A or 20D are plan views schematically showing other modified patterns of the indium layer provided on the sealing part, respectively.
Figure 20C:
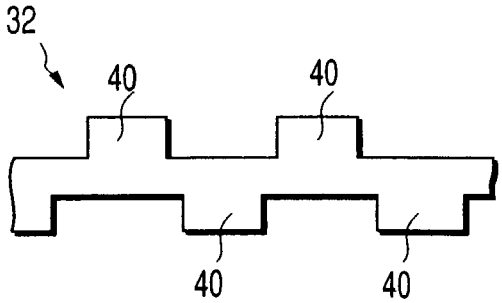

For example, rectangular projections 40 may protrude from both sides of the layer 32 and spaced apart in the lengthwise direction of the layer 32, as is illustrated in FIG. 20A or FIG. 20C. Alternatively, semicircular projections 41 may protrude from both sides of the layer 32 and spaced apart in the lengthwise direction of the layer 32, as is shown in FIGS. 20B and 20D.

Figure 20B:
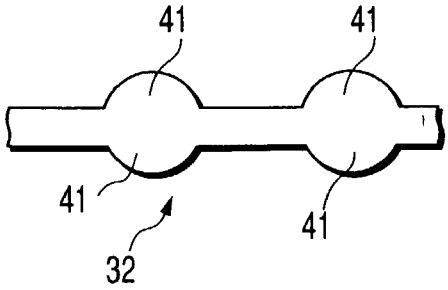
Figure 20D:
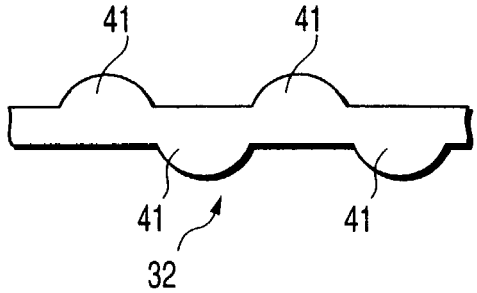

The projections 40 and 41 may be arranged as shown in FIGS. 20A and 20B, each overlapping the nearest one projecting from the opposite side of the layer 32. Alternatively, the projections 40 and 41 may be arranged as shown in FIGS. 20C and 20D, each staggered with respect to nearest one projecting from the opposite side of the layer 32.

Even if the indium layer 32 has any one of these specific patterns, it is possible to suppress the flowing of molten indium. The shape of projections is not limited to a rectangular one and an arcuate one. Any other shape can be selected for the projections. Moreover, the projections only need to protrude from at least one side of the indium layer 32, to prevent the molten indium from flowing.

In the third embodiment described above, a base layer is formed on a sealing surface and an indium layer is formed on the base layer. Instead, no base layer may be formed and an indium layer may be formed directly on the sealing surface. In this case, too, it is possible to suppress the flowing of molten indium, thereby to attain the same functional advantage as in the other embodiments, only if the indium layer has such bent, such curved parts or such projections as described above. Further, indium may be applied while ultrasonic waves are being applied, as in the second embodiment.

Figure 21:
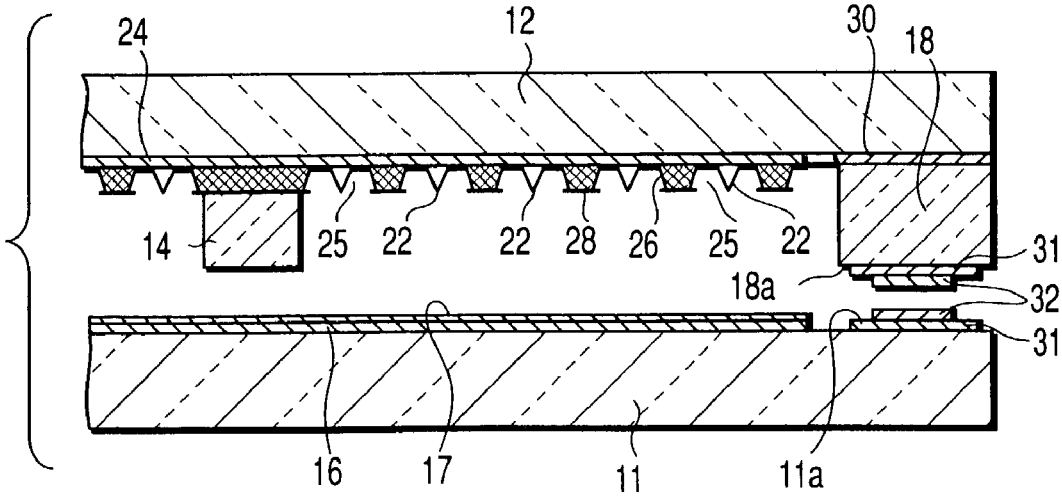
FIG. 21 is a cross-sectional view illustrating how a base layer and an indium layer are formed on the sealing surface of the front substrate, in the process of forming the evacuated envelope of an FED according to another embodiment of this invention.
Figure 19A:
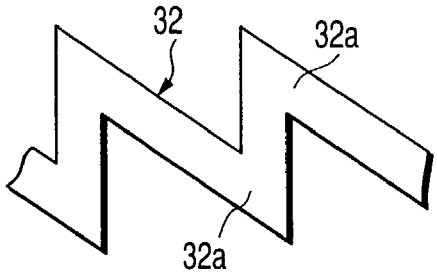
FIGS. 19A to 19D are plan views schematically showing various modified patterns of the indium layer provided on the sealing part, respectively.
Figure 19C:
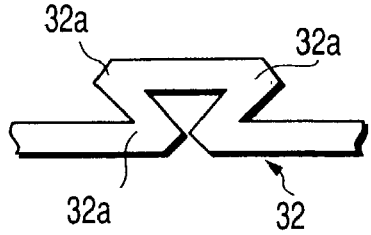
Figure 19B:
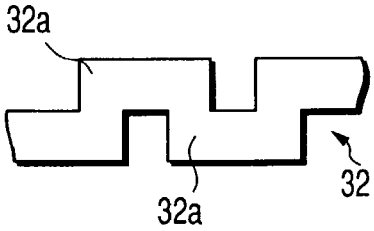
Figure 19D:
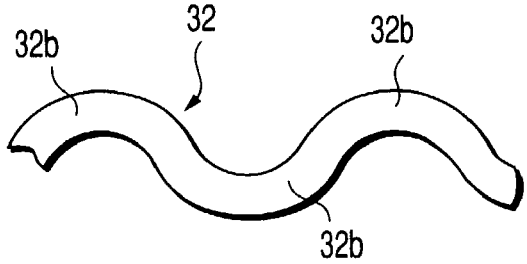

In the third embodiment, the sealing process is carried out, with the base layer 31 the indium layer 32 formed on only the sealing surface 11*a* of the front substrate 11. Nonetheless, the process may be performed, with the layers 31 and 32 formed on only the sealing surface 18*a* of the sidewall 18, or, as shown in FIG. 21, on both the sealing surface 11*a* of the front substrate 11 and the sealing surface 18*a* of the sidewall 18.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, the rear substrate and the a sidewall may be sealed together, by using a sealing layer that comprises a base layer and an indium layer, which are similar to the layers 31 and 32 described above. Furthermore, the front substrate or the rear substrate may be bent at one edge and directly coupled to each other, with no sidewall interposed between them.

In the embodiment described above, the electron-emitting elements used are of field emission type. The electron-emitting elements are not limited to this type. The electron-emitting elements may be of other type, for example, pn type cold-cathode elements, surface conduction type electron-emitting elements, or microchip type electron-emitting elements. Further, this invention can be applied to image display apparatuses of other types, such as plasma display panels (PDP) and electroluminescence (EL) apparatuses.

What is claimed is:

1. A method of manufacturing an image display apparatus which comprises an envelope having a rear substrate, a front substrate opposing the rear substrate, and a plurality of electron-emitting elements provided in the envelope, the method comprising:

continuously applying molten metal sealing material along a sealing surface lying between the rear substrate and the front substrate, while applying ultrasonic waves directly to the molten metal; and heating and melting the metal sealing material in a vacuum atmosphere after the metal sealing material has been applied, and sealing the rear substrate and the front substrate at the sealing surface, either directly or indirectly to each other.

2. A method of manufacturing an image display apparatus, according to claim 1, wherein the applying the metal sealing material includes continuously applying the molten metal sealing material along the sealing surface, thereby forming a metal sealing material layer that extends along the sealing surface.

3. A method of manufacturing an image display apparatus, according to claim 1, wherein ultrasonic waves are applied in a direction substantially perpendicular to the sealing surface in the applying the metal sealing material.

4. A method of manufacturing an image display apparatus according to claim 1, which further comprises forming a base layer on the sealing surface, the base layer being different in material from the metal sealing material layer, and in which the metal sealing material is applied onto the base layer after the base layer has been formed.

5. A method of manufacturing an image display apparatus according to claim 4, wherein the base layer is made by applying metal paste containing at least one element selected from the group consisting of silver, gold, aluminum, nickel, cobalt, copper nickel, gold, silver and copper.

6. A method of manufacturing an image display apparatus according to claim 4, wherein the base layer is a plated layer or deposited layer made of at least one element selected from the group consisting of silver, gold, aluminum, nickel, cobalt and copper, or is a glass material layer.

7. A method of manufacturing an image display apparatus according to claim 1, wherein, in the applying the metal sealing material, a rate of applying the metal sealing material is controlled by changing either output magnitude of the ultrasonic waves or a diameter of a port for applying the metal sealing material.

8. A method of manufacturing an image display apparatus according to claim 1, wherein the metal sealing material is low melting-point metal sealing material having a melting point of 350° C. or less.

9. A method of manufacturing an image display apparatus according to claim 8, wherein the metal sealing material is indium or an alloy containing indium.

10. A method of manufacturing an image display apparatus which comprises an envelope having a rear substrate, a front substrate opposing the rear substrate, a sidewall sealed between peripheral edge parts of the front substrate and the rear substrate; and a plurality of electron-emitting elements provided in the envelope, wherein at least one of sealing surfaces between the front substrate and the sidewall and between the rear substrate and the sidewall, or the front substrate and the sidewall is sealed with a metal sealing material layer, the method comprising:

continuously applying molten metal sealing material along said at least one of sealing surfaces, while applying ultrasonic waves directly to the molten metal; and heating and melting the metal sealing material in a vacuum atmosphere after the metal sealing material has been applied, and sealing the rear substrate, the front substrate and the sidewall together at the sealing surface.

11. A method of manufacturing an image display apparatus comprising an envelope having a rear substrate, a front substrate opposing the rear substrate and sealed either directly or indirectly to the rear substrate with metal sealing material, and a number of electron-emitting elements provided in the envelope, the method comprising:

applying molten metal sealing material to a sealing surface laying between the rear substrate and the front substrate, thereby forming a metal sealing material layer which extends along the entirety of the sealing surface; and heating and melting the metal sealing material in a vacuum atmosphere after the metal sealing material has been applied, and sealing the rear substrate and the front substrate at the sealing surface, either directly or indirectly to each other, wherein, in the step of applying the metal sealing material, bent or curved parts are formed at one portion, at least, of the metal sealing material layer at a predetermined pitch, which extends along a straight part of the sealing surface.

12. A method of manufacturing an image display apparatus according to claim 11, wherein the metal sealing material layer is made of low melting-point metal sealing material having a melting point of 350° C. or less.

13. A method of manufacturing an image display apparatus according to claim 12, wherein the metal sealing material is indium or an alloy containing indium.

* * * * *